United States Patent [19]

Jarvis

[11] Patent Number: 4,827,667

[45] Date of Patent: May 9, 1989

[54] SELF-LOCKING GARAGE DOOR OPERATOR

[76] Inventor: Ralph C. Jarvis, 1220 N. La Cadena, Colton, Calif. 92324

[21] Appl. No.: 128,599

[22] Filed: Dec. 4, 1987

[51] Int. Cl.[4] ..... E05F 15/00

[52] U.S. Cl. ..... 49/280; 49/200; 160/189

[58] Field of Search ..... 49/280, 199, 200, 362, 49/360; 160/189, 201, 206, 207

[56] References Cited

U.S. PATENT DOCUMENTS

| | | | |
|---|---|---|---|
| 913,269 | 2/1909 | Dalhousie . | |
| 1,725,846 | 8/1929 | Brummer . | |
| 1,831,117 | 11/1931 | Huston . | |
| 1,949,133 | 2/1934 | Smith | 292/94 |
| 2,039,296 | 5/1936 | Collins | 20/20 |
| 2,074,347 | 3/1937 | Steiner | 20/20 |
| 2,131,415 | 9/1938 | Woodward | 268/30 |
| 2,703,235 | 3/1955 | Reamey | 49/280 X |
| 2,851,266 | 9/1958 | Klamp | 160/189 |
| 3,435,558 | 4/1969 | Kruse | 49/280 X |
| 3,617,080 | 11/1971 | Miller | 292/38 |
| 3,704,548 | 12/1972 | Wiegleb | 49/199 |
| 3,708,917 | 1/1973 | Streeter | 49/280 |
| 3,909,980 | 10/1975 | Courtney et al. | 49/199 |
| 3,910,611 | 10/1975 | Slovensky | 292/38 |
| 4,442,631 | 4/1984 | Weber | 49/200 X |
| 4,597,224 | 7/1986 | Tucker | 49/199 |
| 4,618,174 | 10/1986 | Duke | 49/280 X |
| 4,739,584 | 4/1988 | Zellman | 49/199 |

FOREIGN PATENT DOCUMENTS

| | | | |
|---|---|---|---|
| 2311161 | 12/1976 | France | 49/199 |

*Primary Examiner*—Philip C. Kannan
*Attorney, Agent, or Firm*—Harvey S. Hertz

[57] ABSTRACT

The invention relates generally to motorized garage door operating apparatus and, more specifically, to such apparatus including mechanical locking means which automatically disengages at the onset of energization of the motorized opening/closing apparatus from the closed door condition before any opening motion of the door begins. The apparatus also operates to activate the locking means after the door is advanced to its fully closed position.

14 Claims, 2 Drawing Sheets

FIG. 1
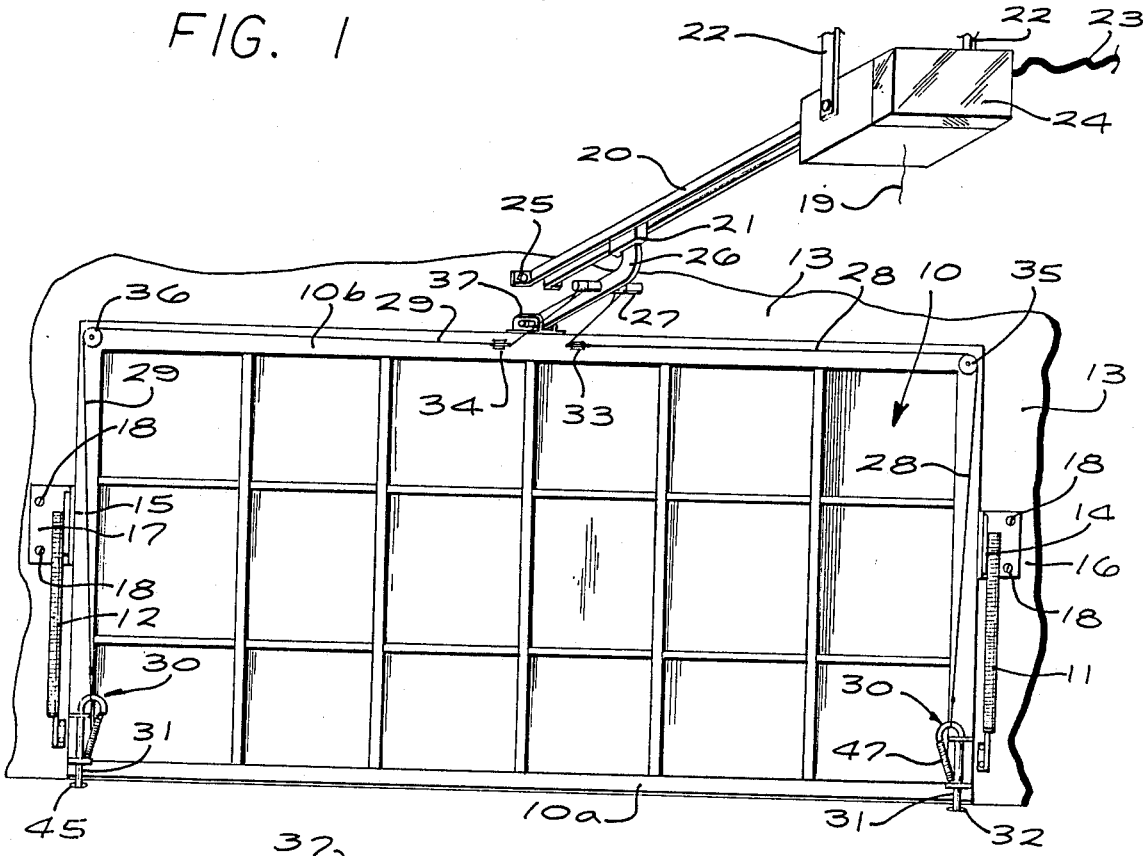
FIG. 2
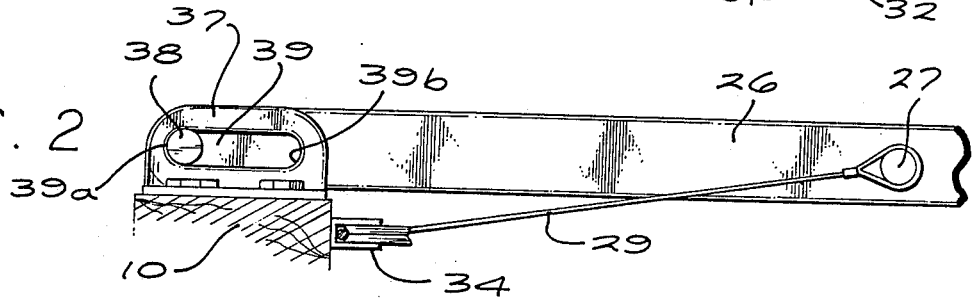
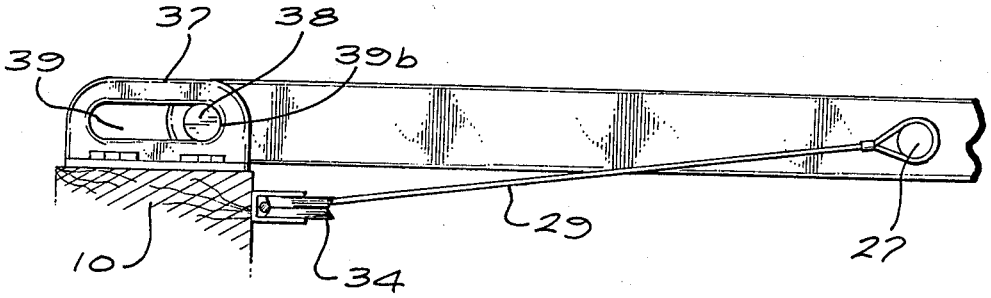
FIG. 3

FIG. 5
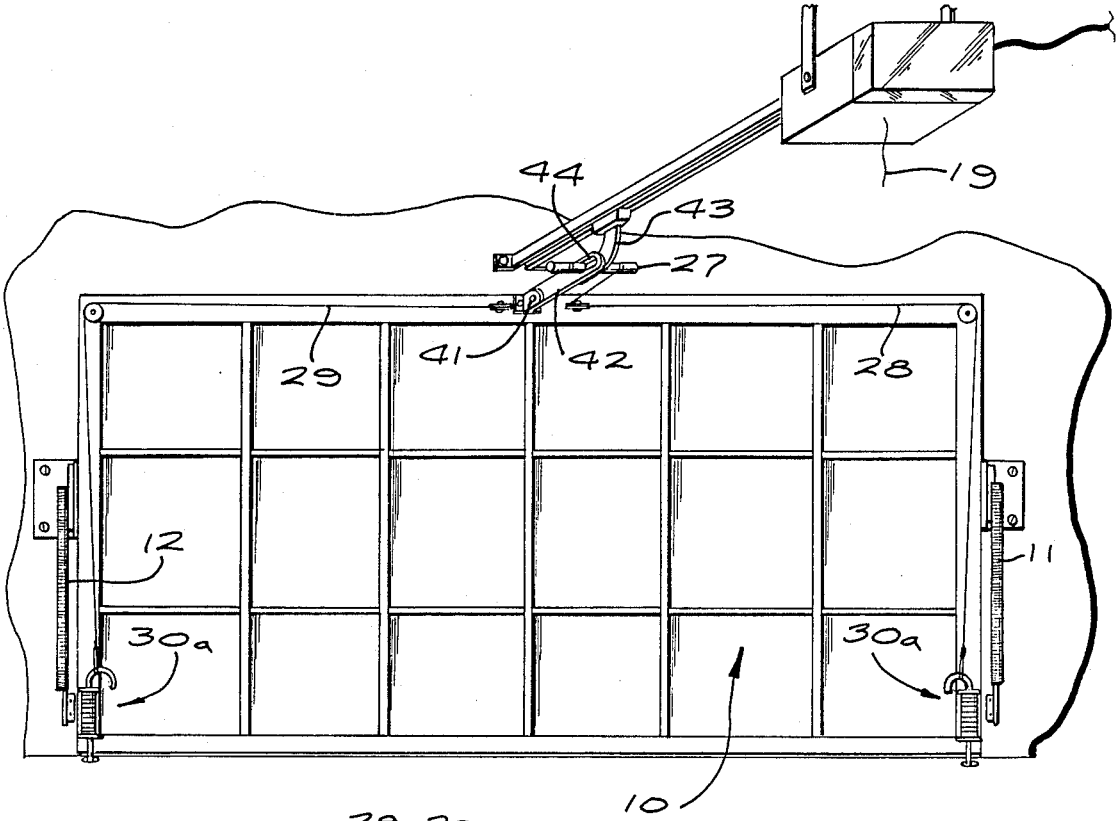
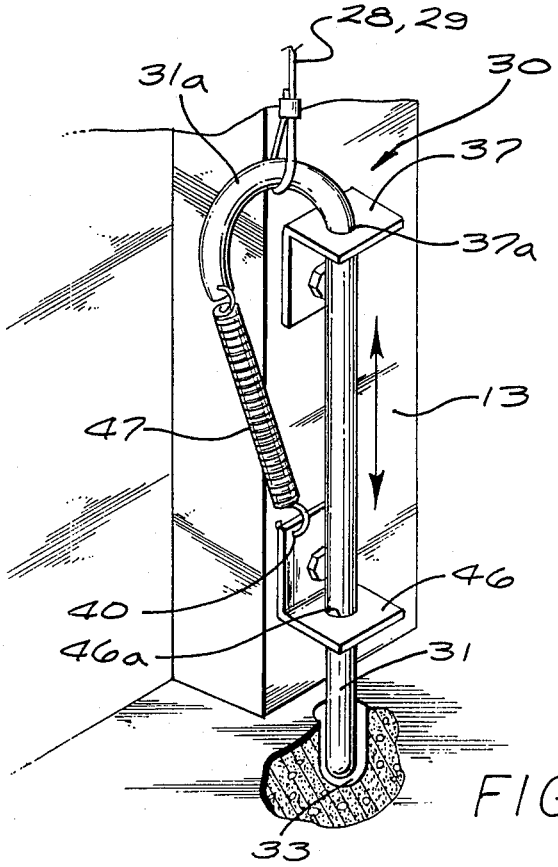
FIG. 4
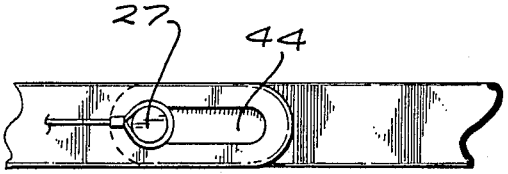
FIG. 6
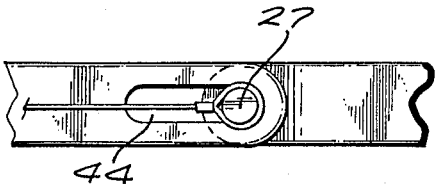
FIG. 7

SELF-LOCKING GARAGE DOOR OPERATOR

BACKGROUND OF THE INVENTION

The invention applies generally to overhead garage doors operated by motorized means which are usually controlled remotely, for example by a small, battery-powered, coded radio transmitter and a responsive decoding receiver associated with a motorized door operator. That arrangement is known and in fact, is in wide use for slab type doors and multi-panel doors. The slab type door is generally a lower cost arrangement vis-a-vis the multi-panel door. The former swings up and down about a fulcrum associated with the mechanical suspension mechanism mounted at both sides of the slab door and garage door opening, whereas the latter travels substantially vertically over the door opening and folds progressively such that the panels are all substantially in a horizontal plane in the door open condition.

The prior art known to the applicant includes a number of U.S. patents relating to side hinged garage type doors or gates of the single or double, swinging type. Examples of such prior art include U.S. Pat. Nos. 913,269; 1,725,846; 1,831,117; 1,949,133; 2,039,296; 2,131,415 and 3,617,080.

In U.S. Pat. No. 913,269 a very early form of manually operated bolt (latch) mechanism on a swinging door is disclosed.

In U.S. Pat. No. 1,725,846 another early swinging door latch device is shown using a manually operated trigger for to effect very rapid door opening, as for example required of the doors of a fire engine house.

U.S. Pat. No. 1,831,117 describes a garage swinging door opening mechanism activated by contact with the bumper of a vehicle preparing to enter the garage.

U.S. Pat. No. 1,949,133 discloses another vehicle activated garage door opener, in that instance responsive to the weight of a vehicle or a "depressible platform" in the driveway surface approaching the garage.

In U.S. Pat. No. 2,039,296, a basic manually operated multiple-panel overhead door is shown. That arrangement could be modified to include the unique self-locking and unlocking structure according to the invention, as will be understood from the description hereafter presented.

U.S. Pat. No. 2,131,415 discloses a slab type overhead garage door with separately operated hydraulic actuation (actually using water as a hydraulic fluid).

U.S. Pat. No. 3,617,080 describes a door latch mechanism for swinging or sliding doors but is not adapted to overhead doors of the slab or multiple panel types.

U.S. Pat. No. 2,074,347 relates to a slab-type overhead door, which is a type of door to which the combination according to the invention is particularly adapted if the motorized and remotely controlled opening and closing apparatus, which is now well known, were also added.

The well known overhead slab door arrangement includes a spring counter-balanced suspension at each lateral position whereby the door is rotated as a unit about a fulcrum associated with the door frame structure. When fully closed the door is in a substantially vertical plane and when fully open it is in a substantially horizontal overhead plane. The spring counterbalance is so arranged that, in closing, the last fraction of the travel to the fully closed position is nearly a free fall, i.e. is not substantially resisted by the spring counterbalancing action. Thus the door tends to stay closed until an intentional opening force is applied.

Upon opening, the slab type overhead door bottom edge typically follows a somewhat irregular arc outward and upward with contemporaneous translation inward with respect to the garage door opening such that the amount of horizontal plane projection outside the garage opening is minimal. The manner in which the well-known characteristics of such a suspension mechanism together with the typical motorized and remotely controlled opening-closing mechanism are employed to advantage in cooperation with the novel structure of the invention will be understood as this description proceeds The well-known garage door opener is not particularly secure against intruders. The door operated by the usual opener/closer is subject to prying from the bottom, usually with damage to the mechanism. Accordingly, there is a great need for simple reliable and inexpensive auxiliary locking means. The provision of such means according to the invention will be appreciated as this specification proceeds Although not described in the patent literature aforementioned, it is known that electric solenoid operated locking both arrangements have been constructed and offered for sale. Those devices operate in conjunction with the typical motorized garage door operator to produce locking of the door the closed position. Such arrangements are relatively expensive however.

SUMMARY OF THE INVENTION

The well-known motorized overhead garage door opener includes means such as a lead screw, chain drive or the like to move a responsive arm member pivotally connected to the top center of the door. In accordance with the invention, that connection is provided with intentional mechanical hysteresis. A very simple and preferred approach to providing that hysteresis is to replace the pivota connection of the aforementioned arm with a pin and slot configuration. A bracket attached to the door top center contains the slot, which extends generally normal to the plane of the door and the pin is affixed to the adjacent end of the arm driven at its other end from the lead screw or chain drive. Basically, the slot and pin arrangement allows the final closing free fall of the door to overtake the drive pin just prior to completion of the final door closing.

At least one cable and pulley arrangement is provided, the cable being attached at one end to a spring loaded locking bolt which nests in the fixed structure (floor for example) of the garage in the fully closed door position. The action of the lead screw or chain drive on opening of the door retracts the arm and pin structure such that the door does not move until the pin engages the inward end of the slot, but the cable, being attached to the arm, is tensioned to withdraw the locking bolt against its own spring means to permit the door to be opened as the pin pulls against the inward end of the slot. In closing, the force effecting closure is caused by contact between the pin and the slot outward end until the door reaches the aforementioned free-fall point, at which the door overtakes the drive and the slot allows the door to move ahead of the drive pin until final closure. The cable is tensioned during this brief period to make certain that the locking bolt is withdrawn just before final closure, the drive pin thereafter being finally positioned against the slot outer end to permit the locking bolt to seat, effecting secure locking of the door in its closed position.

The details of a preferred embodiment according to the invention will be fully understood as this description proceeds.

The general objective of the invention may be said to have been the provision of a simple, inexpensive automatic locking mechanism for an overhead door, which is adapted to be easily retrofitted onto such doors operated by one of the well-known motorized opener/closer systems.

BRIEF DESCRIPTION OF THE DRAWINGS

FIG. 1 is a pictorial of a typical overhead garage door and operating mechanism viewed from inside the garage and including the structure of the invention.

FIG. 2 is a detail of the slot and pin engagement coupling the overhead door to the opener arm, shown in the final door closure position and during closing movement of the door except for the final increment of closure movement FIG. 3 is the same detail as FIG. 2 except shown in the door opening mode.

FIG. 4 is a detail of the spring loaded locking bolt according to the invention.

FIG. 5 is a pictorial of a typical overhead door similar to FIG. 1 except that an alternative control arm, pin and slot configuration is employed.

FIG. 6 the relationship of the slot and pin in the door opening mode for the arrangement of FIG. 5

FIG. 7 shows the relationship between the slot and pin in the door closing made for the configuration of FIG. 5

DETAILED DESCRIPTION

Referring now to the drawings, a typical embodiment will be described in detail. Although a slab overhead door is shown in the drawings, the skilled reader will recognize the applicability of the invention to multi-panel overhead doors.

In FIG. 1, the overhead slab door 10 is shown as viewed from inside the garage with the door 10 closed. Door 10 is supported by a pair of hinging and suspension assemblies 11 and 12. These assemblies 11 and 12 permit the door to be opened and closed. In the open position the door 10 is rotated about fulcrum points 14 and 15 until the door bottom edge 10*a* faces outward and the entire door assumes a position in a substantially. horizontal overhead plane against the lower edge of the garage structure 13. The garage structure 13 identifies those structural members which frame the door opening, the assemblies 11 and 12 being anchored appropriately to the garage structure 13 at the sides, such as by brackets 16 and 17 affixed, for example, to structure 13 by bolts 18.

A motorized operator 19, typically with a lead screw housed in an elongated track 20 effects movement of lead screw follower 21 toward or away from the door opening for closing opening of door 10 respectively.

The motorized operator 19 is usually mounted to the garage ceiling structure by straps 22, for example, and the elongated track 20 is attached to the operator 19 and is anchored to the garage structure 13 at 25. Operator 19 is connected to A.C. power source through electric cord 23 and also has a transluscent end cover 24 through which light from at least one light bulb within is timed to allow automobile occupants time to leave the garage area before being automatically turned off.

The operating cycle for both opening and closing of door 10 is controlled by switches and/or a low-power, hand-held, coded battery powered radio transmitter. This feature and all references in this "Detailed Description" to this point are entirely conventional and well-known. That description is necessary, however, in order to provide background and understanding of the novel aspects of the invention.

Referring again to FIG. 1, it is conventional for the spring counterbalancing provided by assemblies 11 and 12 to be arranged so that, upon door closing the last small fraction of the closing motion of door 10 is significantly more rapid than during the time from initiation of the closing action (when the springs within assemblies 11 and 12 resist closing) to the point where that last small fraction of the closing action taken over. That the configuration of the operation of assemblies 11 and 12 provides that the door, when open, tends to remain open and when closed, tends to remain closed by action of the springs in assemblies 11 and 12.

The novel structure of the invention is best described in combination with its overall operation, letting it be assumed that the door is initially closed. At that time, the lead screw follower 21 is fully forward (toward door 10) and the operator 19 is stopped by action of a limit switch set to detect the most forward position of follower 21 (corresponding to full closure of door 10). Also, arm 26 has driver pin 38 resting at the most forward end 39*a* of slot 39 within slotted bracket 37 (see also FIG. 2). Bracket 37 is otherwise bolted or mounted to the top door structure 10*b* as shown in FIGS. 2 and 3. Slot 39 lies in a plane normal to the plane of door 10 and is affixed to the top horizontal structural member of door 10. The connection of arm 26 within follower 21 is, as is conventional, in known door openers and allows arm 21 some rotational freedom in the vertical plane.

A cable connection rod 27 provides for connection of cables 28 and 29 to arm 26 as shown cable 28 threading therefrom through pullies 33 and 35 to the arched top 31*a* of bolt 31 within locking bolt assembly 30 (right side of door 10) See also FIG. 4 at this time. Cable 29 is similarly threaded through pulleys 34 and 36 to connect to the left floor bolt 45 as shown in FIG. 1. The length of cables 28 and 29 is just sufficient to permit bolts 31 to rest in floor bores (sockets) 32 and 45, respectively as shown. The tension force provided by a spring 47 tends to retain bolts 31 in that position in the closed door position and the door is effectively prevented from swinging outwardly at its bottom edge 10*a* as it must during the door opening action.

Locking bolt assembly 30 will be seen from FIG. 4 to have a pair of drilled angle brackets 37 and 46 to hold locking bolt 31 as shown. The bracket bores 37*a* and 46*a* are of diameter such as to permit easy vertical sliding of bolt 31 therethrough. Let it now be assumed that operator 19 has been energized to open door 10. At the outset, pin 38 is first drawn to the rear position of slot 39 as shown in FIG. 3. During this time there is no net door-opening force, but cables 28 and 29 are tensioned to withdraw locking bolts 31 from the sockets 33 in the garage floor. This withdrawal permits the bottom edge 10*a* of door 10 to swing outward as the door is then opened, the force of pin 38 against slot end 39*b* effecting this action. Opening continues with bolts 31 held in their maximum withdrawal positions as the door continues opening to its horizontal overhead position. A second limit switch associated with operator 19 and follower 21 stops operator 19 and switches the direction of operator 19 action to follow at the initiation of the next door closing cycle.

Assume now that door closing is called for. Operator 19 drives the lead screw to draw follower 21 forward. Immediately the pin 38 travels to the slot end 39*a* without significant door closing force until that pin travel to 39*a* is concluded. Cables 28 and 29 are then slacked, permitting locking bolts 31 to protrude below the bottom of door 10. However, this is of no consequence at that time. As a critical point in the closure is reached (near the closed door position), the spring counterbalancing provided by assemblies 11 and 12 accelerates door closure at a rate greater than the closure rate provided by force of pin 38 against slot end 39*a* and the slotted bracket 37 effectively moves ahead of the pin 38 tensioning the cables 28 and 29 to withdraw locking bolts 31 so that they do not interfere with full door closure. The advance of pin 38 continues however to the position depicted in FIG. 2 slacking cable 28 and 29 once again to permit engagement of bolts 31 into sockets 32 and 33 to automatically effect the desired door locking action. The interaction of pin 38 within slot 39 as described may be characterized as an intentional mechanical hysteresis.

Spring 47 (FIG. 4) will be understood to be anchored to bracket 46 as shown. The arched (cane head) shape 31*a* of bolt 31 provides a back-up manual operating feature.

The alternative configuration shown in FIG. 5 utilizes a conventional door top bracket 41 to which a slotted first arm 42 is pivotally mounted. The cable connection rod 27 also serves as the pin comparable to pin 38 in FIG. 1. Cable connection rod 27 is fixed into second arms 43 and slot 44 effectively pulls or pushes rod 27 as contrasted to the action of pin 38 within slot 39 as applied to the configuration of FIG. 1. FIG. 6 shows the opening relationship of rod 27 and slot 44 and FIG. 7 shows the closing relationship which corresponds to FIGS. 2 and 3 (or 3 and 2) of the embodiment of FIG. 1.

The alternative configuration of FIG. 5 will be understood to operate substantially in the same manner as that of FIG. 1. In FIG. 5 the length of slot 44 can be selected with more ease than is the case in FIG. 1, however. It will be realized that the locking bolt assembly 30 can employ a compression spring around the bolt 31 between brackets 37 and 38 as an alternative form, as shown by compression spring 30*a*. Either form of the locking bolt assembly could be applied to either FIG. 1 or FIG. 5 as an ordinary mechanical option. In fact, various modifications of the mechanical details of the disclosed embodiments are possible once the novel aspects of the invention are fully appreciated.

The cables 28 and 29 may be of any ordinary type, such as braided metal or low stretch non-metallic cord. As an adjustment for initial set-up and to provide for subsequent cable stretch, turnbuckles may be included within the lengths of cables 28 and 29. Although two locking bolt assemblies are shown, it is obviously possible to employ more or only one without departing from the inventive concepts.

The concepts of the invention will be seen to be applicable to an overhead door of the multi-panel type except that the locking bolts would necessarily be oriented to insert themselves into the garage door frame side members, rather than into floor sockets. This is necessary because of the vertical sliding action of such a door.

It will occur to the skilled reader that the invention could also be applied to overhead doors of the multi-panel type. That type of door runs in side tracks rather than about side mounted fulcrums, and slides vertically into closure. Of course, the locking bolt assemblies 30 would need to be oriented laterally to secure such a door. The mechanical hysteresis concept described in connection with the pin and slot arrangement is also applicable to a multi-panel door.

Although a lead screw type of garage door operator has been mentioned in this specification, it is also possible to apply the unique structure and concepts of the invention to other operator forms, for example, the so-called chain drive type of operator.

It will be realized that other modifications and variations will suggest themselves to those of skill in this art, and it is not intended that the scope of the invention be regarded as limited to the specifics of the drawings or this description, these being intended to be illustrative and typical only.

I claim:

1. An overhead garage door opening and closing apparatus including a motorized operator providing substantially linear motion of a first mechanical element in a first direction for closing said door and in a second opposite direction for opening said door and comprising:

a counterbalancing mechanism anchored to the fixed structure associated with the garage door opening, said counterbalancing mechanism providing hinging and tending to hold said door in its open overhead rest position and alternatively in its closed vertical plane rest position, said counterbalancing mechanism further providing closing motion during the last predetermined increment of closing motion of said door accelerated to exceed the rate of closure of said door effected by said motorized operator;

first means comprising a mechanical linkage connecting said first mechanical element to said door, said linkage providing mechanical hysteresis in the direction of said linear motion of said first mechanical element, whereby the first increment of motion of said first mechanical element during each of said door opening and closing motions does not impart motion to said door;

at least one locking bolt arranged to be inserted into a corresponding socket associated with the fixed structure of the garage with which said overhead door is associated;

and second means connected from said first mechanical element to said locking bolt whereby said locking bolt is withdrawn from said socket during said first increment of door opening notion and during the time of said accelerated closing motion during said closing motion of said door.

2. The combination according to claim 1 in which said overhead door is defined as a slab door and said locking bolt socket extends downward into the garage floor structure.

3. The combination according to claim 1 in which said counterbalancing mechanism includes spring means for effecting said accelerated closing motion of said door at a rate exceeding the rate of motion imported by said first mechanical element, said first means being arranged to permit complete closure of said door while said locking bolt is held retracted by said second means, said first mechanical element continues to move thereby to cause said second means to control said locking bolt to extend into said corresponding socket thereby to effect locking of said door.

4. The combination according to claim 3 in which said first means includes a pin and slot arrangement for providing said mechanical hysteresis.

5. The combination according to claim 1 in which said first means includes a pin and slot arrangement for providing said mechanical hysteresis.

6. The combination according to claim 5 in which said second means includes a cable and pulley arrangement and said locking bolt includes resilient means for biasing said bolt into its extended position whenever said second means does not exert a force overcoming the force of said resilient means to retract said locking bolt.

7. The combination according to claim 6 in which said pin and slot arrangement is connected in mechanical series between said first mechanical element and said second means.

8. The combination according to claim 5 in which said pin and slot arrangement is connected in mechanical series between said first mechanical element and said second means.

9. The combination set forth in claim 8 in which said slot lies in a plane normal to said door and extends generally normal to said door.

10. The combination according to claim 9 including a mechanical arm connected at one end to said first mechanical element and having a pin at the other end, said pin slideably engaging said slot over its length.

11. The combination according to claim 1 in which said second means includes a cable and pulley arrangement and said locking bolt includes resilient means for biasing said bolt into its extended position whenever said second means does not exert a force overcoming the force of said resilient means to retract said locking bolt.

12. The combination according to claim 11 in which said overhead door is defined as a slab door and said locking bolt socket extends downward into the garage floor structure.

13. The combination according to claim 1 in which a plurality of said locking bolts is provided and said second means is arranged to control said locking bolts contemporaneously.

14. The combination according to claim 13 in which said overhead door is defined as a slab door and said locking bolt socket extends downward into the garage floor structure.

* * * * *